United States Patent [19]

Prudhomme et al.

[11] 4,287,237

[45] Sep. 1, 1981

[54] PROCESS FOR IMPREGNATING SPOOLS OF TEXTILE WITH A LIQUID COMPOSITION

[75] Inventors: Pierre Prudhomme, Lozanne; Jean-Jacques Lafaye, Lyons; Raymond Rey, Villeurbanne, all of France

[73] Assignee: Seperef - TMP Societe pour l'Equipment des Reseaux en Canalisations de Matieres Plastiques, Saint-Germain-au-Mont-D'or, France

[21] Appl. No.: 64,721

[22] Filed: Aug. 8, 1979

[51] Int. Cl.[3] ..... B05D 7/22

[52] U.S. Cl. ..... 427/238; 8/155.1; 68/189; 118/214

[58] Field of Search ..... 118/DIG. 19, DIG. 22, 118/214; 68/189; 8/155.1; 427/430 R, 430.1, 238: 156/175

[56] References Cited

U.S. PATENT DOCUMENTS

| | | | |
|---|---|---|---|
| 1,850,047 | 3/1932 | Bachmann et al. | 427/430 R X |
| 2,437,987 | 3/1948 | Wolfenden | 68/189 X |

FOREIGN PATENT DOCUMENTS

| | | | |
|---|---|---|---|
| 668506 | 3/1952 | United Kingdom | 8/155.1 |

*Primary Examiner*—Evan K. Lawrence

[57] ABSTRACT

In a process for impregnating a reel of thread in the form of a spool with a liquid resin composition, the thread is arranged on a perforated rigid mandrel so as to form a uniform reel in which the volume of open space approximately corresponds to the desired volume of resin to be impregnated, each spool is then gripped and completely sealed against resin leakage from its ends and, finally, the composition is injected under pressure into the interior of the perforated mandrel whereby there is a homogeneous loss of pressure from the mandrel to the spool's entire exterior curved surface and the resin diffuses uniformly to fill all voids through the spool.

5 Claims, 6 Drawing Figures

PROCESS FOR IMPREGNATING SPOOLS OF TEXTILE WITH A LIQUID COMPOSITION

BACKGROUND OF THE INVENTION

The invention relates to a process for impregnating threads in the form of spools with a liquid composition such as a crosslinkable resin. The invention is particularly suitable for pre-impregnating reinforcing threads for use in crosslinkable plastics.

It is well known to reinforce plastics using textiles of various forms to give end products which are sometimes known as "laminates". In general, the impregnation of the textile material is carried out just before product manufacturing step, that is to say either in the mould itself, where the product is moulded to shape, or on a mandrel where tubes, containers or other hollow articles are being made. Although very widespread, these techniques do exhibit disadvantages. Firstly, since rotating or rubbing members are often used, there is often a large proportion of bubbles in the laminate which leads to imperfections in the finished product. Moreover, since the impregnation time is relatively short, the fibre to plastic bond is sometimes defective, and the impregnation capacity is fairly limited so that thorough and homogeneous impregnation is difficult to carry out. Finally, the composition of the resulting laminate tends not to be homogeneous, within or between laminates, which quite obviously limits their applications.

It has also been proposed to impregnate the threads by passage through a tank of suitable resin, but in this technique, it is necessary to pass the threads over numerous guides, and this causes the fretting and sometimes even breaking of the individual strands.

it has also been suggested to wind the threads onto a mandrel and then to spray the resin thereon, but in this case, the resulting laminate again possesses numerous bubbles, which detracts from its properties and spoils its appearance.

Finally, in all these techniques in which the impregnation is carried out from the outside towards the inside, the installations are generally bulky, expensive and rather impractical.

It has also been proposed to carry out the treatment from the inside towards the outside (see, for example, Swiss Pat. Nos. 374,046 and 561/74) by placing the textile as a reel on a perforated mandrel. Unfortunately, this technique as developed thus far, which is satisfactory for dyeing or moistening reels, is not suitable for resin impregnation because the resin disposition is not sufficiently uniform and the installation frequently becomes clogged.

The present invention aims to overcome these disadvantages.

SUMMARY OF THE INVENTION

According to the present invention there is provided a process for impregnating a reel of thread with a liquid composition, for instance of crosslinkable resin in which the thread to be impregnated is arranged as a uniform reel of which the open volume approximately corresponds to the desired volume of resin on a perforated rigid mandrel to form a spool, the mandrel having perforations which are staggered and spaced along the entire length of the mandrel except at the ends thereof, and each spool is then gripped at its ends, and the said composition is injected under pressure into the perforated mandrel.

The process of the invention is easier to operate and more economical to carry out than previous processes, and the resulting laminates possess to a reduced extent the defects listed above.

Advantageously, the perforations in the mandrel are circumferential slots which are arranged uniformly and are staggered relative to one another along the mandrel.

In practice, several spools are preferably superposed, separated from one another by means of a rigid support plate, and pressure is applied to each end.

The invention is particularly suitable for treating chemical threads intended for reinforcing laminates. High performance carbon threads, boron threads and aromatic polyamide threads may be mentioned. "Roving" glass threads can advantageously be treated, according to the invention, in which the individual filaments are arranged side by side, without twist, in the form of a ribbon.

The mandrel used in the process of the invention can be made of any rigid material which is insensitive to the treatment conditions, such as, for example, metal or plastic (pvc and the like). As already stated, the mandrel must be perforated, it being possible for these perforations advantageously to be circumferential slots or holes. Slots which are arranged radially and staggered relative to one another in the axial sense are preferably used so as to assist the penetration of the resin. In practice, the two ends of the mandrel are left free of any slots in order to avoid preferential leakage of resin at the ends. It has been found that, with mandrels of usual dimensions, good results are obtained if each end has a portion of approximately 30 mm length without slots.

In a known manner, a reel with straight sides is formed on this mandrel, the travel, i.e. length, of the reel corresponding to the length of the mandrel. The spooling conditions are defined so as to obtain a spool density which leaves an open volume, i.e. spaces, corresponding to the desired volume of resin. In practice the ratio of weight of resin to the weight of thread is preferably one sixth to one third, as opposed to one third ($\frac{1}{3}$) to a half ($\frac{1}{2}$) for the conventional processes mentioned above. Moreover, the conditions of formation of the reel must be suitable for enabling the impregnated spool to be easily unwound. For example, with a glass roving, it has been determined that good results are obtained if:

the bulk density of the reel (that is to say of the roving on the spool) is between 1.35 and 1.75, the crossing is between 2.5 and 3.5, preferably of the order of 3.25 (the crossing being the number of turns of thread per length of spool), and the laying index is of the order of 0.5 to 0.6 (the laying index being the space, expressed in width of thread, which separates two turns which lie in the same direction but belong to successive layers; in other words, a laying index of 0.55 means that the turn, lying in the same direction, of the layer following the reference layer is laid at a distance of 0.55 times the width or the diameter of the thread).

As already stated, in practice, the ends of the spool are preferably straight, that is to say they form a plane which is approximately perpendicular to the generatrices of the mandrel. However, it is understood that the use of other shapes of reel, such as to give biconical spools, is not excluded. Thus, because of the spooling, these sides are composed of a circular reel which is produced when the crossing is inverted, and this leads to a higher density of the spool on these sides and hence to a lower loss of pressure and consequently a better lateral leaktightness.

Pure resins which are commonly used for the manufacture of laminates can be used as the impregnation resin. Examples which may be mentioned are polyesters, unsaturated polyene-esters and epoxy, furane and acrylic resins. The liquid composition of resin also contains various catalysts and various known adjuvants (an accelerator, promoter, inhibitor, photosensitiser, dyestuff or the like). The viscosity of the composition can vary as a function of the treatment conditions. Good results are obtained with acrylic resins based on oxyethyleneated bisphenol A dimethacrylate (OBDMA).

DESCRIPTION OF THE DRAWINGS

In order that the invention may be more clearly understood, the following description is given by way of example only, with reference to the accompanying drawings in which one embodiment of the invention is described and in which.

DESCRIPTION OF PREFERRED EMBODIMENTS

Figure 1:
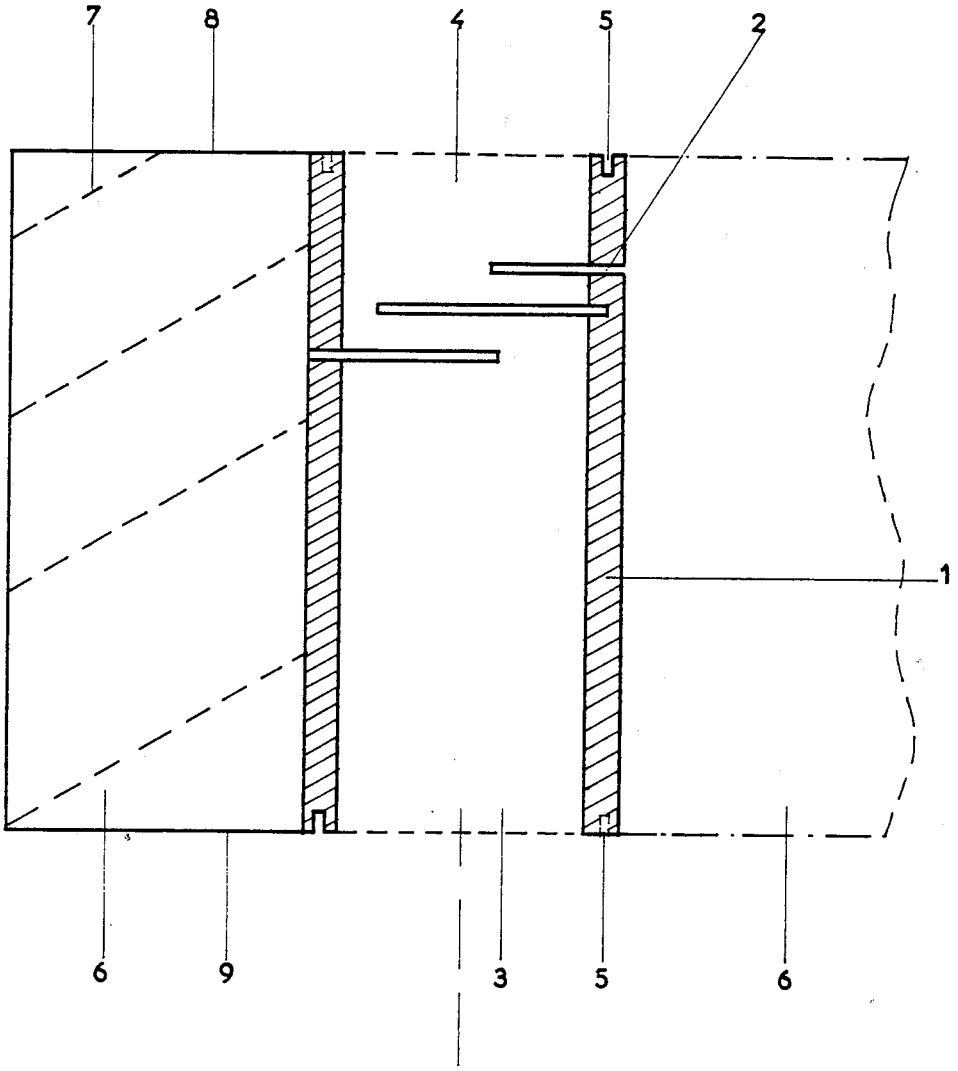
FIG. 1 schematically shows, in section, a reel of thread on a mandrel in accordance with the invention.

With reference to FIG. 1, which is a schematic representation only, shown at 1 is a rigid mandrel, for example made of rigid pvc, having, for example, the following dimensions:

internal diameter: 76 millimeters
external diameter: 90 millimeters
length: 270 millimeters;

Indicated at 2 are some of a plurality of slots which are 2 mm wide and which are cut, for example, with a saw so as to include at the centre an angle of about 120°. The slots are staggered relative to one another by about 60° and are spaced 10 to 15 millimeters apart along the entire length of the mandrel 1 except at the two ends 3 and 4 which are each free of slots for a distance of about 30 mm. Slots 5 in the wall of the mandrel at its ends are for centering the spool in order to ensure ease of subsequent unwinding; while the reel of textile is shown at 6, this being formed by individual turns 7 of thread. At 8 and 9 are straight ends of the spool, which are flush with each end of the mandrel 1 and are perpendicular to the mandrel axis.

In a particular embodiment, the spools are formed by winding a 4,720 Tex roving glass thread, which is without twist and is formed by continuous individual 13.5 $\mu$ filaments (origin Owens Corning Fibreglass (OCF), sizing type 891), with a crossing of 3.37, a laying index of 0.55 and a density of 1.35. As already stated, the travel of this spool is 270 millimeters. Each individual spool weighs about 17 kilograms and has a proportion of resin of 25% by weight.

Other embodiments have been produced with the following reels:

1,200 Tex glass roving (origin OCF), 17.5 $\mu$ filaments; crossing 2.54; laying index 0.55; density of the reel before treatment 1.75; proportion of resin deposited (OBDMA) 17%.

2,400 Tex glass roving (origin OCF), 13.5 $\mu$ filaments; crossing 2.55; laying index 0.5; density of the reel before treatment 1.56; proportion of resin deposited (OBDMA) 22.50%.

Figure 2:
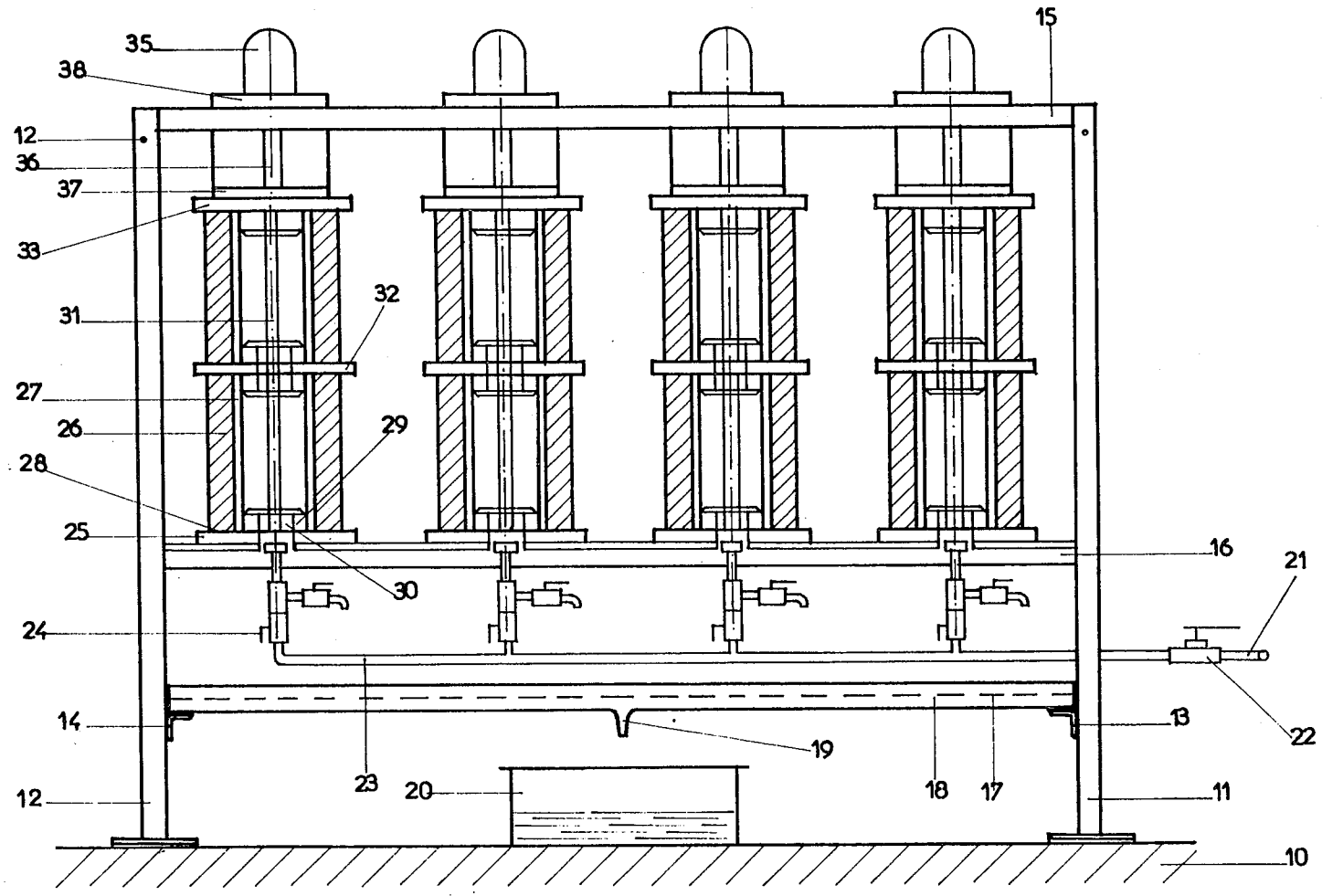
FIG. 2 shows a side view of a pre-impregnation installation for use in performing the process of the invention.

In performing the process of the invention, a plurality of spools are stacked on a carriage (see FIG. 2) which is mounted on slides or on wheels or the like, and these spools are separated from one another by a plane rigid support plate on which their ends rest. With reference to FIG. 2, at 10 is the ground or floor; 11 and 12 denote two vertical metal struts; 13 and 14 denote L-shaped support angle-bars; 15, 16 and 17 denote horizontal crosspieces; 18 denotes a conduit arranged on the crosspiece 17 in order to form a recovery trough; 19 denotes a pipe for the resin to flow in to the recovery tank 20; 21 denotes a pipe for feeding the resin under pressure with an isolation valve 22 connected to a container, not shown, of pressurised resin; 23 denotes a liquid-dispensing manifold with an inlet valve 24 for each position of the spools or stacks of spools. At 25 is a lower rigid plate (see detail in FIG. 4) on which the spools 26, and, more precisely, the mandrel 27 and the bottom ends 28 of the reels, rest; this plate 25 is surmounted by a tenon 29 which is pierced at 30 to allow the passage of a support and centering bar 31, consisting, for example, of a square tube closed at its two ends; the external diameter of this tenon 29 approximately corresponding to the internal diameter of the mandrel 1. At 32 is an intermediate rigid plate (see detail in FIG. 5) on the bottom of which rests the upper end of the lower spool, and on the top of which rests the lower end of the upper spool; this plate, which, like the above mentioned plate 25 is made of a rigid material which is insensitive to the treatment conditions (for example made of polypropylene), has an orifice at its centre for the passage of the centering tube 31. A solid upper rigid plate 33 (see datail in FIG. 6) surmounts the upper of the two spools, while a pneumatic jack 35, for example to give a thrust of 7 kg/cm$^2$ has a bearing 38, a thrust rod 36 and a force-distributing plate 37, for example made of metal, which rests on the upper rigid plate 33. The jack 35 is connected in conventional manner to a compressed air supply which is not shown.

Figure 3:
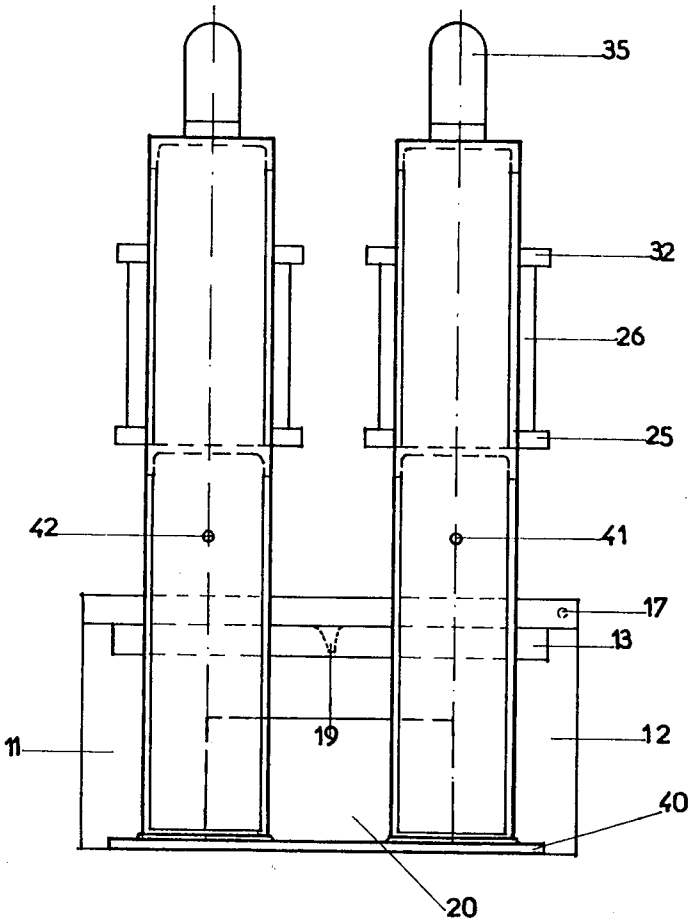
FIG. 3 is a front view of the installation of FIG. 2.

In the side view (see FIG. 3), 40 shows the fixing base plate and 41–42 show bores in a strut for the passage of the resin inlet pipe 21. As shown in FIG. 3, the installation is of the so-called "double-face" type and, in practice, comprises four superposed spools per row, although, for the clarity of the drawing, only two spools have been shown in each row.

Figure 4:
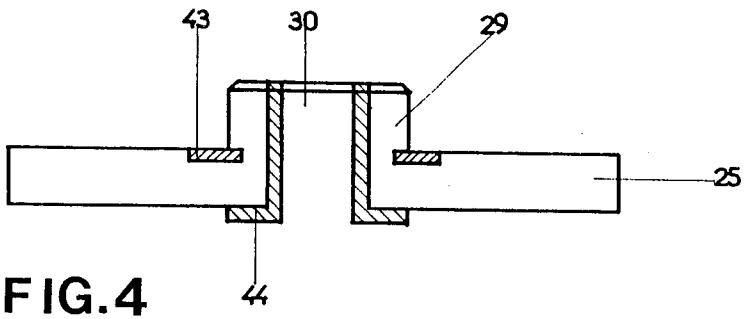
FIGS. 4 to 6 respectively illustrate, in section, the lower, intermediate and upper plane rigid plates in the installation of FIGS. 2 and 3.
Figure 5:
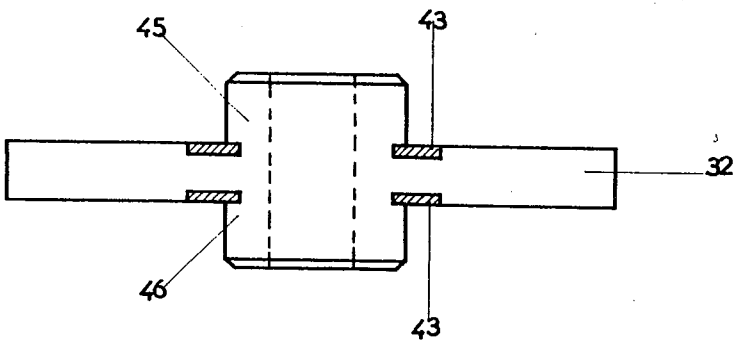
Figure 6:
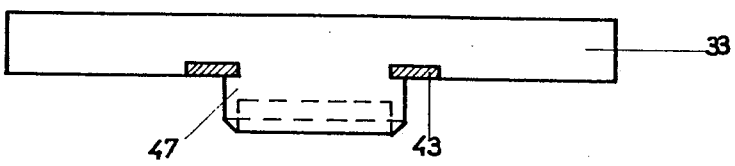

In FIGS. 4 to 6, which show the three plates 25, 32 and 33 respectively, numeral 43 in each case denotes a gasket, for example made of elastomer, on which the end of the mandrel 27 rests, and 44 denotss the branch on the pipe 21 extending into the lower plate 25.

The diameters of the tenons 29, 45, 46 and 47 are slightly greater than the internal diameter of the mandrel 27, and the diameters of the plates 23, 32 or 33 are slightly greater than the diameter of the spool 26 to be treated.

This installation functions as follows.

The resin composition, together with its sensitiser, is placed in a pressurised container which is not shown. Several spools are stacked in rows on top of one another with the plates contacting their ends, and the centering bar 31 being placed at the centre of the mandrel and of the various rigid plates, namely the lower plate 25, the intermediate plate 32 and the upper plate 33. The jacks 25 are then placed under pressure by means of a compressed air circuit which is not shown.

The carriage and the container of resin are then placed in a conventional over and heated to 50°–55° C. by means of recycled air. The initial viscosity of the resin, typically 23 poises is thus reduced to one poise. The container of resin is then connected at its bottom to the pipe 21 and at its top to a compressed air supply which is not shown (for example of 3 kg/cm$^2$).

The various valves 22–24 are then opened so as to initially drive the air from the circuit through the reels 26. Gradually, the expelled air is replaced by the resin which diffuses through the spools 26. Excess resin which comes out of the spools is recovered by gravity in the conduit 18 and then in the tank 20 via the pipe 19.

By virtue of the windings of the reels 26, each spool behaves as an individual valve. In fact, the winding of the threads gives a homogeneous loss of pressure from the mandrel to the exterior curved surface surface of the spool and thus enables the resin to diffuse uniformly to fill all voids throughout the spool.

Moreover, since the ends of the mandrel do not possess slots, there are no leakages from the ends of the spool during impregnation, and the impregnation thus takes place homogeneously.

The impregnation operation is terminated when no more small bubbles are seen on the surface of the reels. In practice, this operation can take between five and seven hours.

The pressure of the compressed air on the resin is then cut off, the jacks 35 are then released and, finally, the carriage is removed from the oven.

The spools impregnated or pre-impregnated in this way exhibit numerous advantages compared with spools obtained with the techniques described in the introduction. There may be mentioned, inter alia;

small losses of starting materials during the operation, constant and precise proportion of resin deposited, homogeneous and uniform deposit on the spool and, in particular, on the thread itself, that is to say that the resin homogeneously penetrates between the filaments of the thread itself, by virtue of this homogeneity, a smaller amount of resin deposits than in the conventional techniques, which improves the mechanical properties of the laminates, a small proportion of bubbles (less than 0.5%), and compact, simplified and practical equipment.

The laminates produced using these pre-impregnated spools are uniform and homogeneous and possess excellent mechanical properties. These impregnated spools can advantageously be used in the techniques of lamination on a mandrel or by "extrusion/spraying", that is to say techniques of the type in which the impregnated threads travel continuously. The manufacture of tubes, poles or hollow containers may be mentioned by way of example.

We claim:

1. A process for impregnating at least one reel of thread in the form of a spool with a liquid composition, for instance of crosslinkable resin, comprising;

(a) for each said reel, arranging the thread as a uniform reel in which the total open volume approximately corresponds to the desired volume of resin to be impregnated on a perforated rigid mandrel to form a spool, said mandrel having perforations which are staggered and spaced along the length of said mandrel except at the portions thereof aligned with the ends of each said spool, (b) gripping each said spool at its ends and completely sealing same against fluid leakage from said ends, and (c) injecting said composition under pressure through said perforated mandrel into each said spool so that there is a homogenous loss of pressure from said mandrel to the spool's exterior curved surface and the desired volume of resin uniformly and homogenously impregnates said spool by filling void-free the spaces between said threads and the interstices within said threads.

2. The process according to claim 1 wherein a plurality of said spools with straight ends are impregnated and said spools in the step of arranging are superimposed, and in the step of gripping are separated from one another by rigid plates resting on the ends of said spools and thereby sealing means against fluid leakage from said ends, the diameter of said plates being slightly greater than the diameter of the spools, the superimposed spools being pressed together by applying a pressure to each end, and said rigid plates being made of plastic material and having a gasket to seal said plates to said mandrel.

3. The process according to claim 2 wherein said superimposed spools engage intermediate and lower plates having orifices connected to a pipe and from said pipe feeding crosslinkable resin into each of said mandrels.

4. The process according to claim 1 wherein said thread is a glass roving without twist, the bulk density of the reel is between 1.35 and 1.75, the crossing of the reel is of the order of 3.5, the laying index of the thread on the spool is between 0.5 and 0.6, and each of the two ends of the mandrel and free of perforations.

5. The process according to claim 1 wherein said thread is a roving without twist and said spool is wound with said thread whereby the crossing and the laying indexes of the spool are arranged to have a uniform reel, the bulk density of which is between 1.35 and 1.75, and the ratio of weight of resin to the weight of thread is between 1:6 and 1:3.

* * * * *